US007080796B2

(12) United States Patent
Tomiita

(10) Patent No.: US 7,080,796 B2
(45) Date of Patent: Jul. 25, 2006

(54) FUEL INJECTION VALVE

(75) Inventor: Yukio Tomiita, Anjo (JP)

(73) Assignee: Denso Corporation (JP)

( * ) Notice: Subject to any disclaimer, the term of this patent is extended or adjusted under 35 U.S.C. 154(b) by 17 days.

(21) Appl. No.: 10/909,315

(22) Filed: Aug. 3, 2004

(65) Prior Publication Data

US 2005/0067507 A1 Mar. 31, 2005

(30) Foreign Application Priority Data

Sep. 25, 2003 (JP) ..... 2003-333570

(51) Int. Cl.
*F02M 61/00* (2006.01)

(52) U.S. Cl. ..... 239/533.12; 239/103; 239/106; 239/120; 239/497; 239/552; 239/584; 239/585.1; 239/596

(58) Field of Classification Search ..... 239/103, 239/104, 106, 120, 121, 122, 288, 288.3, 239/288.5, 494, 497, 533.12, 552, 584, 585.1, 239/585.3, 585.5, 596

See application file for complete search history.

(56) References Cited

U.S. PATENT DOCUMENTS

| | | | | |
|---|---|---|---|---|
| 5,323,966 | A * | 6/1994 | Buchholz et al. | 239/533.12 |
| 5,533,482 | A * | 7/1996 | Naitoh | 239/585.1 |
| 5,881,957 | A * | 3/1999 | Mizuno et al. | 239/596 |
| 6,783,087 | B1 * | 8/2004 | Aoki et al. | 239/596 |
| 2002/0062866 | A1 * | 5/2002 | Sumiya et al. | 251/129.18 |

FOREIGN PATENT DOCUMENTS

| | | |
|---|---|---|
| JP | 11-117832 | 4/1999 |
| JP | 2000-73918 | 3/2000 |

* cited by examiner

*Primary Examiner*—Steven J. Ganey
(74) *Attorney, Agent, or Firm*—Nixon & Vanderhye PC

(57) ABSTRACT

A fuel injection valve has a nozzle having a valve seat formed along an inner wall of the nozzle. Injection holes are located on an outlet side of the valve seat. An outlet section, at which a fuel outlet of the injection hole is open, is provided to said nozzle on a side opposite to said valve seat. An enlargement section extends away from the valve seat while being gradually enlarged from an edge of said outlet section in a radial direction.

11 Claims, 5 Drawing Sheets

FUEL INJECTION VALVE

CROSS REFERENCE TO RELATED APPLICATIONS

This application is based upon, claims the benefit of priority of, and incorporates by reference Japanese Patent Application No. 2003-333570 filed Sep. 25, 2003.

BACKGROUND OF THE INVENTION

1. Field of the invention

The present invention relates to a fuel injection valve for injecting fuel.

2. Description of the Related Art

Atomization of fuel injected from a fuel injection valve is important to ensure that exhaust discharged from an engine conforms to emission regulations, and to improve fuel efficiency. To improve the atomization of fuel, the diameter of an injection hole, through which fuel having passed through a valve seat flows, can be small. In making the diameter of the injection hole small, it is preferable to shorten the length of the injection hole, in order to achieve the desired injection characteristics by reducing the pressure loss in the injection hole. Thus, when the injection holes are formed in an injection hole member, it is necessary to thin the thickness of a plate of the injection member. Thinning the plate of the injection hole member, however, makes it difficult to secure adequate strength of the injection hole member. Accordingly, the injection hole member is attached to a nozzle body with, for example, a separate holding member (refer to Japanese Patent Laid-Open Publication No. 2000-73918, hereinafter called as "patent document 1"). Otherwise, the injection hole member has a thin portion where the injection holes are to be formed, and a thick portion for securing its adequate strength (refer to Japanese Patent Laid-Open Publication No. 11-117832, hereinafter called as "patent document 2"). Thus, the strength of the injection hole member, and the strength of a connection section between the injection hole member and the nozzle body are secured.

When the injection hole member is held by the holding member, as disclosed in patent document 1, a step is formed between an end face of the injection hole member on the opposite side to the nozzle body, at which outlets of the injection holes are open, and an end face of the holding member on the opposite side to the nozzle body. Also in the technique disclosed in patent document 2, a step is formed between the thick portion and the thin portion of the injection hole member, at which outlets of the injection holes are open. A quantity of fuel injected from the injection holes adheres to the periphery of the injection holes. Thus, when the step is formed in the vicinity of the injection holes, the fuel adhering in the vicinity of the injection holes accumulates in the vicinity of the step by surface tension, without dispersing in the air. If the fuel accumulated in the step is solidified by ambient heat, the injection holes may be clogged. As a result, there is a possibility that the desired injection characteristics will not be achieved.

SUMMARY OF THE INVENTION

An object of the present invention is to provide a fuel injection valve that prevents adhesion of fuel in the vicinity of a fuel outlet side of injection holes in order to achieve the desired injection characteristics.

According to a first aspect of teachings of the present invention, an enlargement section extends in an opposite direction to a valve seat while being gradually enlarged from an edge of an outlet section, at which a fuel outlet of an injection hole is open outward in a radial direction. Thus, fuel adhering to the periphery of the injection hole easily flows along the enlargement section, without accumulating in a connection section between the outlet section and the enlargement section. As a result, the fuel is prevented from adhering to the vicinity of the fuel outlet of the injection hole, so that the injection hole is prevented from being clogged with solidified fuel. Therefore, it is possible to achieve the desired injection characteristics.

According to a second aspect of teachings of the present invention, the enlargement section has a tapered surface. An internal diameter of the tapered surface is enlarged from the edge of the outlet section in the opposite direction to the valve seat. Accordingly, the outlet section and the enlargement section form a large angle. Thus, the fuel adhering to the periphery of the injection hole easily flows along the enlargement section, without accumulating in the connection section between the outlet section and the enlargement section. As a result, the fuel is prevented from adhering to the vicinity of the fuel outlet of the injection hole, so that the injection hole is prevented from being clogged with solidified fuel. Therefore, it is possible to achieve the desired injection characteristics.

According to a third aspect of teachings of the present invention, the closer the plurality of tapered surfaces to the outlet section, the larger angle the tapered surface forms with a central axis of a nozzle. Of the plurality of tapered surfaces, the tapered surface connected to the outlet section forms a large angle with the outlet section. Thus, fuel adhering to the periphery of the injection hole easily flows along the enlargement section, without accumulating in the connection section between the outlet section and the enlargement section. As a result, the fuel is prevented from adhering in the vicinity of the fuel outlet of the injection hole, so that the injection hole is prevented from being clogged with solidified fuel. Therefore, it is possible to achieve the desired injection characteristics.

According to a fourth aspect of teachings of the present invention, since a curved surface of the enlargement section is recessed toward the valve seat, a connection section between the curved surface and the outlet section forms a gentle large angle. Thus, fuel adhering to the periphery of the injection hole easily flows along the enlargement section, without accumulating in the connection section between the outlet section and the enlargement section. As a result, the fuel is prevented from adhering in the vicinity of the fuel outlet of the injection hole, so that the injection hole is prevented from being clogged with solidified fuel. Therefore, it is possible to achieve the desired injection characteristics.

According to a fifth aspect of teachings of the present invention, the injection holes are formed in an injection hole member. Since the injection hole member has the enlargement section, a portion in which the injection hole is formed is thin, and a portion connected to the nozzle body is thick. Thus, it is possible to secure adequate thickness which is necessary for maintaining strength, while preventing adhesion of fuel to the periphery of the injection hole. Therefore, it is possible to achieve the desired injection characteristics.

According to a sixth aspect of teachings of the present invention, the injection hole member has a cylindrical section for covering the outer periphery of the nozzle body. The injection hole member is held by the nozzle body at the cylindrical section. Accordingly, it is possible to make a bottom section thick to ensure adequate strength, and make the cylindrical section thinner than the bottom section. As a result, when the injection hole member is secured to the nozzle body by, for example, welding, it is possible to reduce the number of processes necessary for welding by means of welding the thin cylindrical section. Therefore, it is possible to reduce the number of manufacturing processes.

According to a seventh aspect of teachings of the present invention, the injection hole member, in which the injection hole is formed, is sandwiched between the nozzle body and a holder. Thus, the injection hole having a small diameter is formed in the thin injection hole member, and it is possible to secure the necessary strength by the holder. A step is not formed between the injection hole member and the holder because the holder has the enlargement section. Thus, fuel adhering to the periphery of the injection hole easily flows along the enlargement section, without accumulating in the connection section between the outlet section and the enlargement section. As a result, the fuel is prevented from adhering in the vicinity of the fuel outlet of the injection hole, so that the injection hole is prevented from being clogged with solidified fuel. Therefore, it is possible to achieve the desired injection characteristics.

According to an eighth aspect of teachings of the present invention, the holder has a cylindrical section for covering the outer periphery of the nozzle body. The holder is held by the nozzle body at the cylindrical section. Accordingly, it is possible to make a bottom section thick to secure adequate strength, and make the cylindrical section thinner than the bottom section. As a result, when the holder is secured to the nozzle body by, for example, welding, it is possible to reduce the number of processes necessary for welding by means of welding the thin cylindrical section. Therefore, it is possible to reduce the number of manufacturing processes.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

First Embodiment

Figure 2:
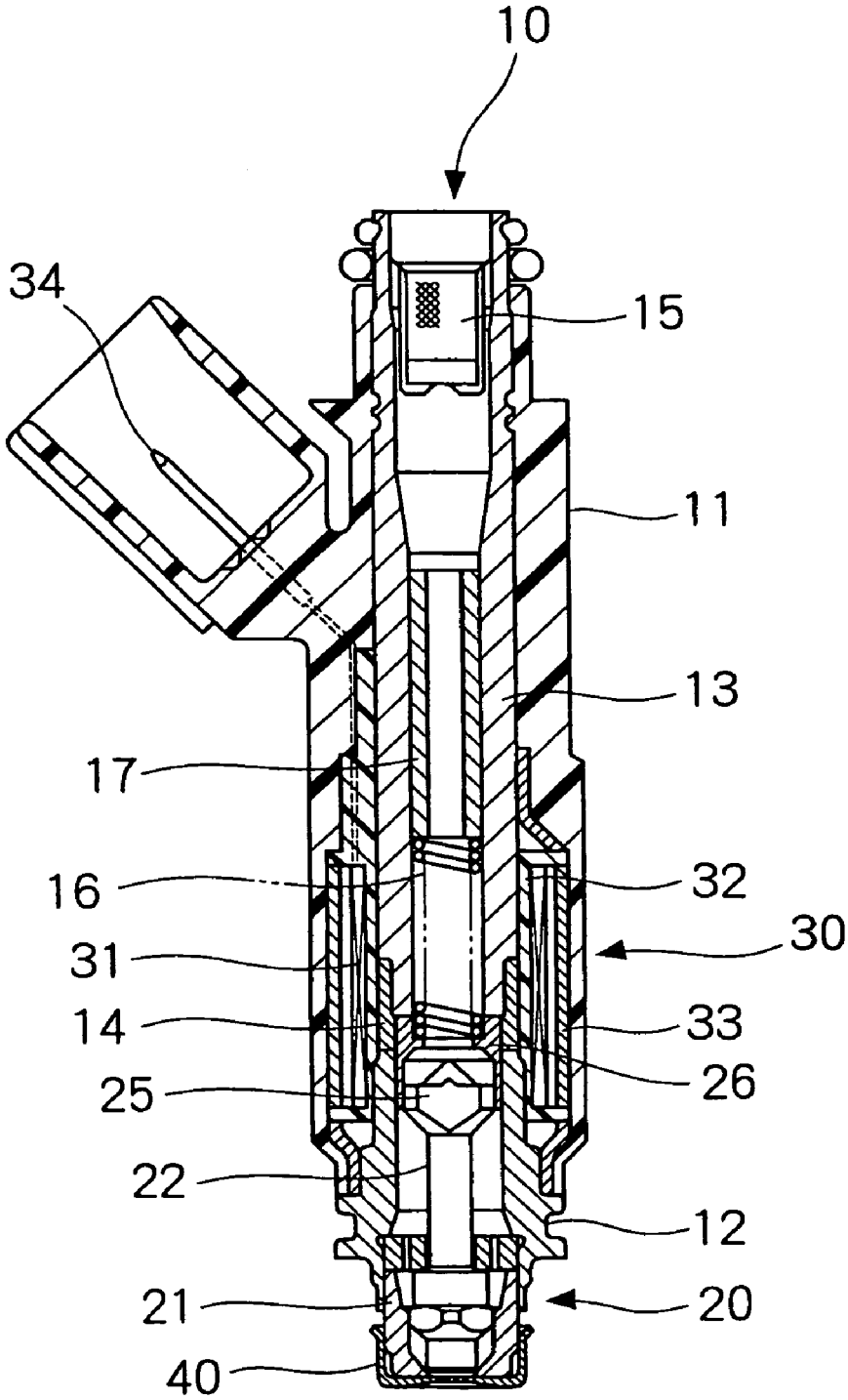
FIG. 2 is a cross-sectional view of the injector according to the first embodiment of the present invention.

FIG. 2 shows a fuel injection valve (the fuel injection valve will be hereinafter called "injector") according to a first embodiment of the present invention. The first embodiment describes an example in which the present invention is applied to an injector of a so-called premixing type engine that injects fuel into an intake port of a gasoline engine.

A casing 11 of an injector 10 made of, for example, a molded resin, covers a magnetic pipe 12, a fixed core 13, a driving section 30, and the like. A nozzle 20 is provided at an end portion of the magnetic pipe 12. A non-magnetic pipe 14 is provided between the magnetic pipe 12 and the fixed core 13 to prevent a magnetic short. The fixed core 13 and the non-magnetic pipe 14, and the non-magnetic pipe 14 and the magnetic pipe 12 are joined by, for example, laser beam welding or the like.

Figure 1:
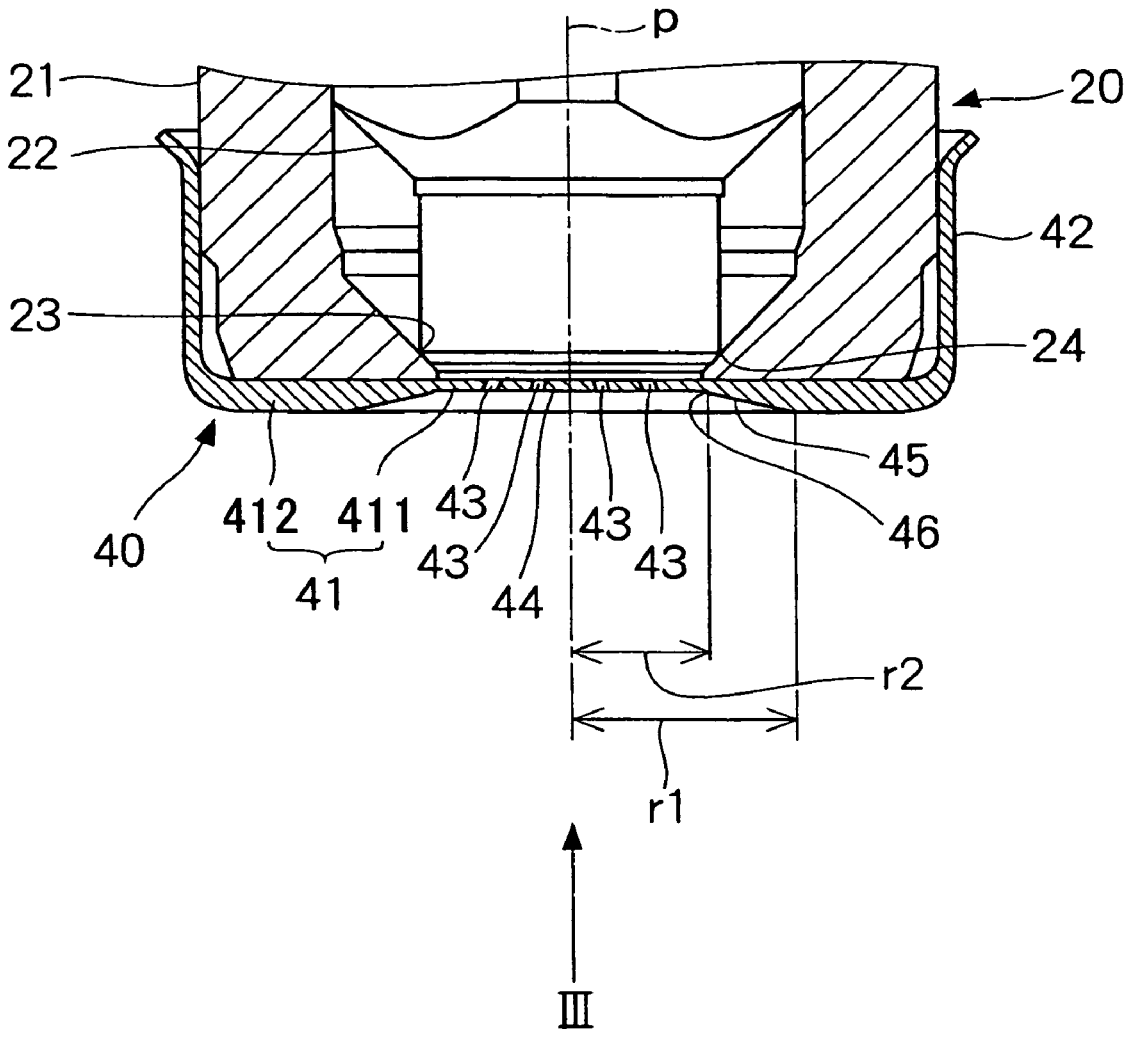
FIG. 1 is a cross-sectional view showing a nozzle of an injector according to a first embodiment of the present invention.

The nozzle 20 has a nozzle body 21, a needle 22 as a valve member, and an injection hole member 40. The nozzle body 21 is joined to the magnetic pipe 12 by, for example, laser beam welding or the like. The needle 22 is contained in the magnetic pipe 12 and the nozzle body 21 in a reciprocating manner. A valve seat 23, as shown in FIG. 1, is formed in the inner wall of the nozzle body 21. A seal section 24 formed in the needle 22 can be seated on the valve seat 23 of the nozzle body 21. When the injector 10 is applied to a direct-injection engine, an end portion of the nozzle body 21 is exposed to a combustion chamber of the engine.

Referring to FIG. 2, a joint section 25 provided in the needle 22 on the opposite side to the seal section 24 is coupled to a movable core 26. The fixed core 13 is approximately the shape of a cylinder, and fuel flows on the inner periphery thereof. A filter 15 is provided at an end portion of the fixed core 13 on the end opposite to the nozzle body 21, to eliminate foreign matter contained in the fuel. An adjusting pipe 17 for adjusting the biasing force of the spring 16 is press-fitted into the fixed core 13. One end of the spring 16 comes into contact with the adjusting pipe 17, and the other end thereof comes into contact with the movable core 26, which is integral with the needle 22. The spring 16 applies a load toward the needle 22, and forces the needle 22 and the movable core 26, integrally, against the nozzle body 21, that is, in the direction of seating the seal section 24 on the valve seat 23.

The driving section 30 is provided to the needle 22 on the side opposite to the seal section 24. The driving section 30 includes a coil 31, a spool 32, and a magnetic plate 33. The coil 31 is wound around the spool 32. The magnetic plate 33, made of a magnetic metal such as iron, covers the periphery of the spool 32 around which the coil 31 has been wound. The magnetic pipe 12, the fixed core 13, the movable core 26, and the magnetic plate 33 are magnetically connected to form a magnetic circuit. The coil 31 is contained in the casing 11 together with the magnetic pipe 12 and the fixed core 13, which are positioned so as to sandwich the non-magnetic pipe 14.

The coil 31 is electrically connected to a terminal 34. The terminal 34 is connected to an engine control unit (ECU) (not shown). Electric power output from the ECU at predetermined timing is supplied to the coil 31 through the terminal 34. When the electric power is supplied to the coil 31, magnetic flux flows in the magnetic circuit by a magnetic field generated in the coil 31. Thus, magnetic attraction force occurs between the fixed core 13 and the movable core 26.

Next, the nozzle 20 will be described in detail. The nozzle 20, as described above, has the nozzle body 21, the needle 22, and the injection hole member 40. The injection hole member 40 is provided to cover an end portion of the nozzle body 21 on the opposite side to the magnetic pipe 12. The injection hole member 40, as shown in FIG. 1, is formed in the shape of a cup having a bottom section 41 and a cylindrical section 42. The bottom section 41 is formed in the shape of an approximate circle corresponding to the outside shape of an edge of the nozzle body 21. The cylindrical section 42 extends from a radially outward peripheral edge of the bottom section 41 in the direction of the nozzle body 21. The internal diameter of the cylindrical section 42 is slightly larger than the external diameter of the nozzle body 21. Thus, the cylindrical section 42 covers the outer periphery of the nozzle body 21. The injection hole member 40 is fixed on the nozzle body 21 by a welding technique such as laser beam welding.

The bottom section 41 of the injection hole member 40 has injection holes 43, an outlet section 44, and an enlargement section 45. The injection hole member 40 is disposed to be approximately coaxial with the nozzle body 21. The plurality of injection holes 43 are formed in the bottom section 41 of the injection hole member 40. The bottom section 41 is composed of a thin plate section 411 in which the injection holes 43 are formed, and a thick plate section 412 formed outside of the thin plate section 411 in the radial direction.

The injection holes 43, penetrating the thin plate section 411 of the bottom section 41, connect an end face of the thin plate section 411 on the side of the nozzle body 21 to the other end face thereof on the opposite side to the nozzle body 21. Fuel outlets of the injection holes 43 are open at an end face of the thin plate section 411 on the opposite side to the nozzle body 21. The end face of the thin plate section 411 on the opposite side to the nozzle body 21, at which the fuel outlets of the injection holes 43 are open, becomes the outlet section 44.

The thin plate section 411 forming the outlet section 44 is formed to be approximately circular, the center of which is located at a central axis p of the injection hole member 40. The inner periphery 412*a* of the thick plate section 412 is positioned outside of the edge 411*a* of the thin plate section 411 apart from a predetermined distance in the radial direction. The outer periphery 412*b* of the thick plate section 412 is connected to the cylindrical section 42. Thus, the edge 411*a* of the thin plate section 411, and the inner periphery 412*a* and the outer periphery 412*b* of the thick plate section 412 are concentric with respect to the central axis p of the injection hole member 40. Referring to FIG. 1, the cylindrical section 42 is thinner than the thick plate section 412 of the bottom section 41 in the injection hole member 40. Thus, when the injection hole member 40 is fixed on the nozzle body 21 at the cylindrical section 42, it is possible to reduce a tab for welding of the injection hole member 40.

The edge 411*a* of the thin plate section 411 and the inner periphery 412*a* of the thick plate section 412 are connected by an inclined surface, which is the enlargement section 45. The enlargement section 45 extends to the opposite direction to the nozzle body 21, while being enlarged from the edge 411*a* of the thin plate section 411 forming the outlet section 44 outward in the radial direction. Thus, in the inner periphery of the bottom section 41, the enlargement section 45 is tapered in such a manner that the internal diameter of the enlargement section 45 is successively enlarged when approaching the side opposite to the nozzle body 21. Namely, the enlargement section 45 has a tapered surface. An end portion of the enlargement section 45 on the opposite side to the outlet section 44 is connected to the inner periphery 412*a* of the thick plate section 412.

Since the enlargement section 45 is formed in a tapered shape, as shown in FIG. 1, an angle formed between the outlet section 44 and the enlargement section 45 in the edge of the outlet section 44 becomes larger than 90 degrees. Therefore, a step 46 formed in a connection section between the outlet section 44 and the enlargement section 45 becomes extremely small. In the case of the first embodiment, the step 46 formed between the outlet section 44 and the enlargement section 45 is set to 0.01 mm or less. Accordingly, if a quantity of fuel flowing out of the injection holes 43 adheres to the outlet side of the injection holes 43, and the adhering fuel flows in the vicinity of the step 46 between the outlet section 44 and the enlargement section 45, the fuel flows to the opposite side of the nozzle body 21 along the tapered surface of the enlargement section 45. As a result, the fuel has difficulty accumulating between the outlet section 44 and the enlargement section 45. Since the step 46 is set to 0.01 mm or less, surface tension acting on the fuel is reduced, so that the accumulation of the fuel in the vicinity of the step 46 can be prevented.

Figure 3:
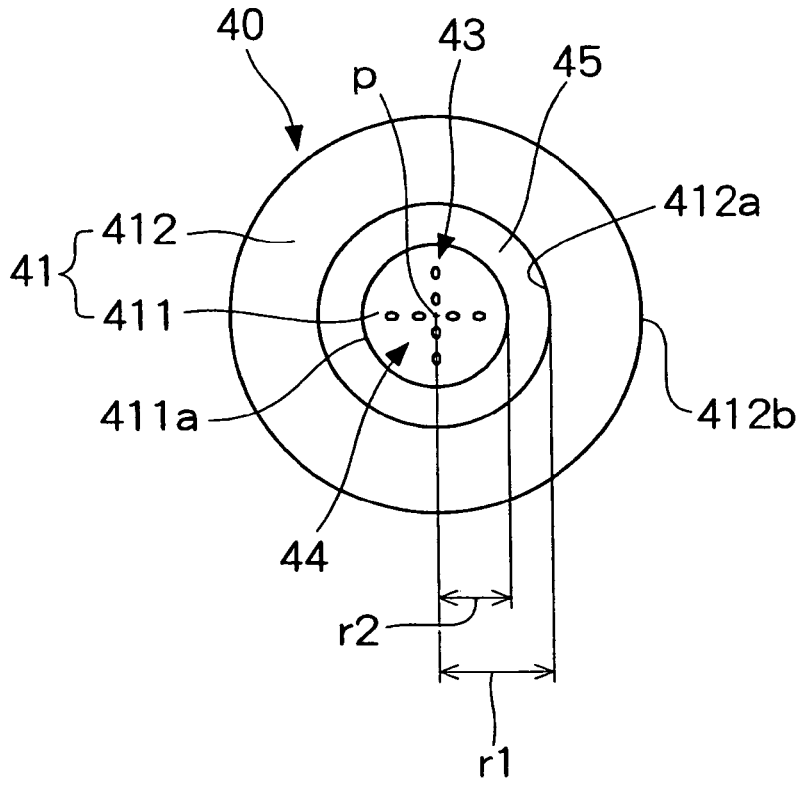
FIG. 3 is a plan view shown in the direction of the arrow III of FIG. 1.

The bottom section 41 of the injection hole member 40 is projected, as shown in FIG. 3, in an area S1 inside of the inner periphery 412*a* of the thick plate section 412, which is a connection section between the enlargement section 45 and the thick plate section 412, is larger than an area S2 of the thin plate section 411, which is the outlet section 44. In other words, the area S1 inside the enlargement section 45 at an end portion of the enlargement section 45 on the opposite side to the nozzle body 21 is larger than the area S2 inside the enlargement section 45 at an end portion of the enlargement section 45 on the side of the nozzle body 21.

At this time, it is preferable that area S2 is twice or more as large as area S1. In other words, when the internal diameter of the thick plate section 412, that is, the internal diameter of the end portion of the enlargement section 45 on the opposite side to the nozzle body 21 is represented by r1, and the internal diameter of the thin plate section 411, that is, the internal diameter of the end portion of the enlargement section 45 on the side of the nozzle body 21 is represented by r2, it is preferable that r2 is set at approximately 1.4 times or more larger than r1. When S2 is approximately twice or more as large as S1, in other words, r2 is approximately 1.4 times or more as large as r1, an angle formed between the outlet section 44 and the enlargement section 45 becomes large in a connection section between the outlet section 44 and the enlargement section 45. Hence the step formed between the outlet section 44 and the enlargement section 45 becomes small. As a result, the fuel is hard to accumulate in the connection section between the outlet section 44 and the enlargement section 45.

Next, the operation of the injector 10 will be described. When supply of the electric power to the coil 31 is stopped, the needle 22 is moved downward in FIG. 2 together with the integral movable core 26 by the pressing force of the spring 16. Thus, the seal section 24 of the needle 22 is seated on the valve seat 23 of the nozzle body 21. Therefore, an opening is not formed between the valve seat 23 and the seal section 24, and hence the fuel is not injected from the injection holes 43. At this time, a gap is formed between the fixed core 13 and the movable core 26.

When the electric power is supplied to the coil 31, the magnetic field occurring in the coil 31 generates the magnetic flux in the magnetic circuit, which is composed of the magnetic pipe 12, the fixed core 13, the movable core 26, and the magnetic plate 33. When the magnetic flux flows, the magnetic attraction force occurs between the fixed core 13 and the movable core 26, which are separate from each other. Thus, the needle 22, integral with the movable core 26, moves toward the fixed core 13, that is, moves upward in FIG. 2, which causes the seal section 24 to separate from the valve seat 23. The needle 22, integral with the movable core 26, moves upward in FIG. 2, until the movable core 26 comes into contact with the fixed core 13. When the seal section 24 separates from the valve seat 23, the fuel flows into an intake side of the injection holes 43 through an opening formed between the seal section 24 and the valve seat 23. Then, the fuel is injected from an end portion on the fuel outlet side into the intake port of the engine through the injection holes 43.

When supply of the electric power to the coil 31 is stopped, the magnetic attraction force occurring between the fixed core 13 and the movable core 26 vanishes. Thus, the needle 22 and the movable core 26, integral with the needle 22, are moved downward in FIG. 2 by the pressing force of the spring 16. The seal section 24 of the needle 22 is seated on the valve seat 23 of the nozzle body 21 once again. As a result, injection of the fuel from the injection holes 43 is stopped.

In the first embodiment, as described above, the outlet section 44, at which the end portions of the injection holes 43 on the fuel outlet side are open, and the tapered enlargement section 45 are connected at a large angle. Thus, the fuel that has been left on the fuel outlet side of the injection holes 43 in injecting the fuel, flows on the side opposite to the nozzle body 21 along the enlargement section 45 without accumulating in the connection section between the outlet section 44 and the enlargement section 45. Accordingly, the solidified fuel does not adhere in the vicinity of the fuel outlet of the injection holes 43. As a result, it is possible to prevent clogging of the injection holes 43 with the solidified fuel, even if the length of the injection holes 43 is shortened and the internal diameter of the injection holes 43 is reduced. Therefore, it is possible to achieve the desired injection characteristics and realize atomization of the fuel.

In the first embodiment, since the injection holes 43 are formed in the thin plate section 411, it is possible to easily reduce the entire length of the injection holes 43. The thick plate section 412 is disposed on the periphery of the thin plate section 411, so that it is possible to secure adequate strength of the injection hole member 40, even if the nozzle 20 is subjected to combustion gas at high pressure in a combustion chamber. The cylindrical section 42 extending from the bottom section 41 to the outer periphery of the nozzle body 21 is thinner than the thick plate section 412 of the bottom section 41. Accordingly, when the injection hole member 40 is fixed on the nozzle body 21 by welding, a tab necessary for welding between the injection hole member 40 and the nozzle body 21 is reduced. Therefore, processing of the injector 10 becomes easy, and hence it is possible to reduce the number of processing steps.

Second Embodiment

Figure 4:
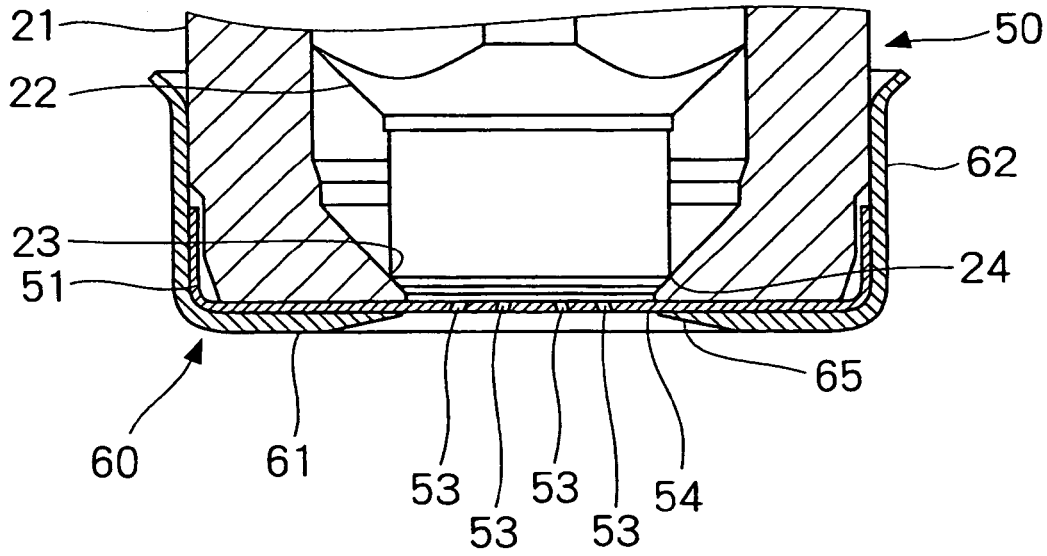
FIG. 4 is a cross-sectional view showing a nozzle of an injector according to a second embodiment of the present invention.

FIG. 4 shows a nozzle of an injector according to a second embodiment of the present invention. The same reference numerals as those of the first embodiment refer to substantially identical components, and description thereof will be omitted.

A nozzle 50 of an injector 10 according to the second embodiment has a nozzle body 21, a needle 22, an injection hole plate 51 as an injection hole member, and a holder 60. The injection hole plate 51, disposed on the opposite side to a valve seat of the nozzle body 21, is sandwiched between the nozzle body 21 and the holder 60. The injection hole plate 51 is formed to be approximately disk-shaped, and an end portion of the injection hole plate 51, outside in a radial direction, is folded in the direction of a magnetic pipe 12. A plurality of injection holes 53 are formed in the injection hole plate 51. The injection holes 53, penetrating the injection hole plate 51, connect an end face of the injection hole plate 51 on the side of the nozzle body 21 to the other end face thereof on the side opposite to the nozzle body 21. Fuel outlets of the injection holes 53 are open at the end face of the injection hole plate 51 on the side opposite to the nozzle body 21. The end face of the injection hole plate 51 on the side opposite to the nozzle body 21, at which the fuel outlets of the injection holes 53 are open, is designated as an outlet section 54.

The holder 60 has a bottom section 61 and a cylindrical section 62. The bottom section 61 holds the injection hole plate 51, in such a manner as to sandwich the injection hole plate 51 between the bottom section 61 and an end face of the nozzle body 21 on the side opposite to the magnetic pipe 12. The cylindrical section 62 extends from a radially outward edge of the bottom section 61 toward the magnetic pipe 12. The internal diameter of the cylindrical section 62 is slightly larger than the external diameter of the nozzle body 21. Thus, the cylindrical section 62 covers the outer periphery of the nozzle body 21.

After the injection hole plate 51 is sandwiched between the nozzle body 21 and the holder 60, the holder 60 is fixed on the nozzle body 21 by, for example, laser beam welding. Thus, the injection hole plate 51 is held between the nozzle body 21 and the holder 60. The cylindrical section 62 is thinner than the bottom section 61 in the holder 60. The injection hole plate 51 is not sandwiched in a welding portion between the nozzle body 21 and the holder 60. Therefore, in the case of fixing the holder 60 on the nozzle body 21 by welding the cylindrical section 62, it is possible to reduce a tab for welding of the holder 60.

The holder 60 has an opening, the inner peripheral side of which corresponds to the outlet section 54 of the injection hole plate 51. The outlet section 54 of the injection hole plate 51 held between the nozzle body 21 and the holder 60 is exposed to an intake port of an engine through the opening of the holder 60. The internal diameter of the inner periphery of the holder 60 increases toward the side opposite to the nozzle body 21. In other words, the inner periphery of the holder 60 has an enlargement section 65, which extends from the edge of the outlet section 54 toward the side opposite to the nozzle body 21 while being radially enlarged in the direction away from the outlet section. The enlargement section 65, as in the case of the first embodiment, has a tapered surface.

Figure 5:
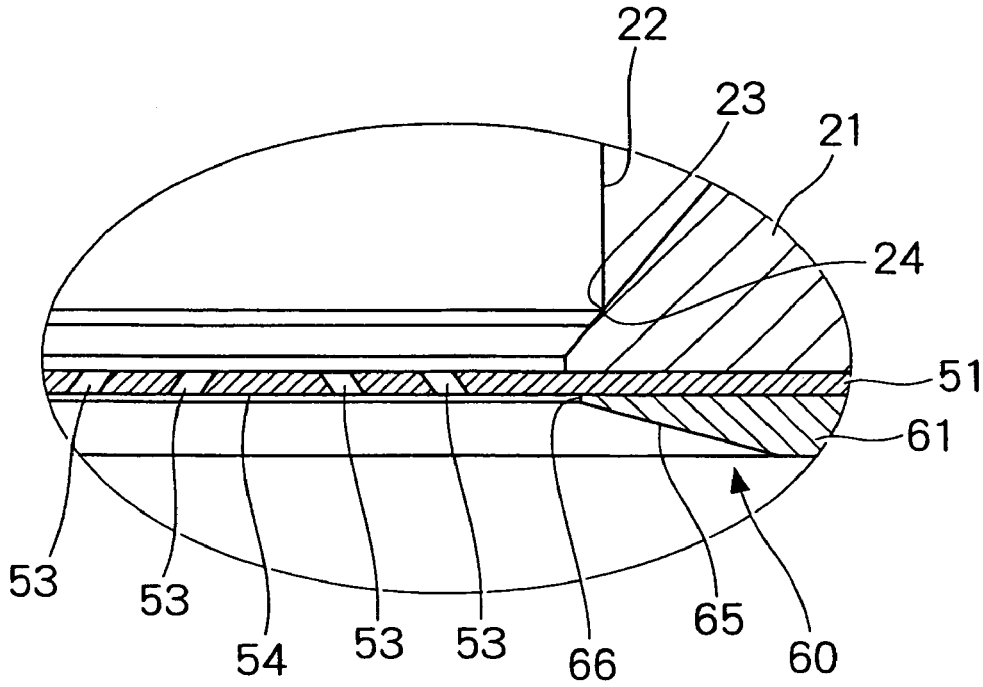
FIG. 5 is an enlarged cross-sectional view of an injector nozzle portion of FIG. 4.

Since the enlargement section 65 has the tapered surface, an angle formed between an end face of the injection hole plate 51 on the side opposite to the nozzle body 21 (being the outlet section 54) and the tapered surface of the enlargement section 65 becomes larger than 90 degrees. Since the enlargement section 65 has the tapered surface, as shown in FIG. 5, a step 66 formed at an end portion on the inner peripheral side of the holder 60, that is, about the axial length of the inner periphery of the holder 60, becomes extremely small. In the case of the second embodiment, the step 66 formed at the end portion on the inner peripheral side of the holder 60 is set to 0.01 mm or less. Thus, when a quantity of fuel flowing out of the injection holes 53 adheres to an outlet side of the injection holes 53, and the adhering fuel flows into a connection section between the outlet section 54 and the enlargement section 65, that is, in the vicinity of the step 66, the fuel flows on the side opposite to the nozzle body 21 along the tapered surface of the enlargement section 65. As a result, it is unlikely for the fuel to accumulate between the outlet section 54 and the enlargement section 65.

In the second embodiment, as in the case of the first embodiment, an area S1 inside the enlargement section 65 in an end portion on the side opposite to the nozzle body 21 becomes larger than an area S2 inside the enlargement section 65 in an end portion on the side of the nozzle body 21. The relation between S1 and S2 and the relation between r1 and r2 are the same as those of the first embodiment, so the detailed description will not be repeated.

In the second embodiment, the injection hole plate 51, in which the injection holes 53 are formed, is held by the holder 60 between the holder 60 and the nozzle body 21. The enlargement section 65 of the holder 60 forms a large angle with the outlet section 54 of the injection hole plate 51. Thus, the fuel left on the fuel outlet side of the injection holes 53 during injection flows along the enlargement section 65, without accumulating in the connection section between the outlet section 54 and the enlargement section 65. Thus, it is possible to prevent the solidified fuel from adhering in the vicinity of the fuel outlet of the injection holes 53. As a result, it is possible to prevent clogging of the injection holes 53 with the solidified fuel, even if the entire length of the injection holes 53 is shortened and the internal diameter of the injection holes 53 is reduced. Therefore, it is possible to achieve desired injection characteristics and realize atomization of the fuel.

In the second embodiment, since the injection holes 53 are formed in a plate-shaped injection hole plate 51, it is possible to easily change the entire length of the injection holes 53 by adjusting the thickness of the injection hole plate 51. Therefore, it is possible to easily achieve the desired injection characteristics. Furthermore, making the bottom section 61 of the holder 60 thick will provide adequate strength of the injection hole plate 51 and the holder 60 without changing the thickness of the injection hole plate 51. On the other hand, the cylindrical section 62 is thinner than the bottom section 61 in the holder 60. Accordingly, when the holder 60 is fixed to the nozzle body 21 by welding, a tab necessary for welding between the holder 60 and the nozzle body 21 is reduced. Therefore, processing of the injector 10 becomes easy, and hence it is possible to reduce the number of processing steps.

Third and Fourth Embodiments

Figure 6:
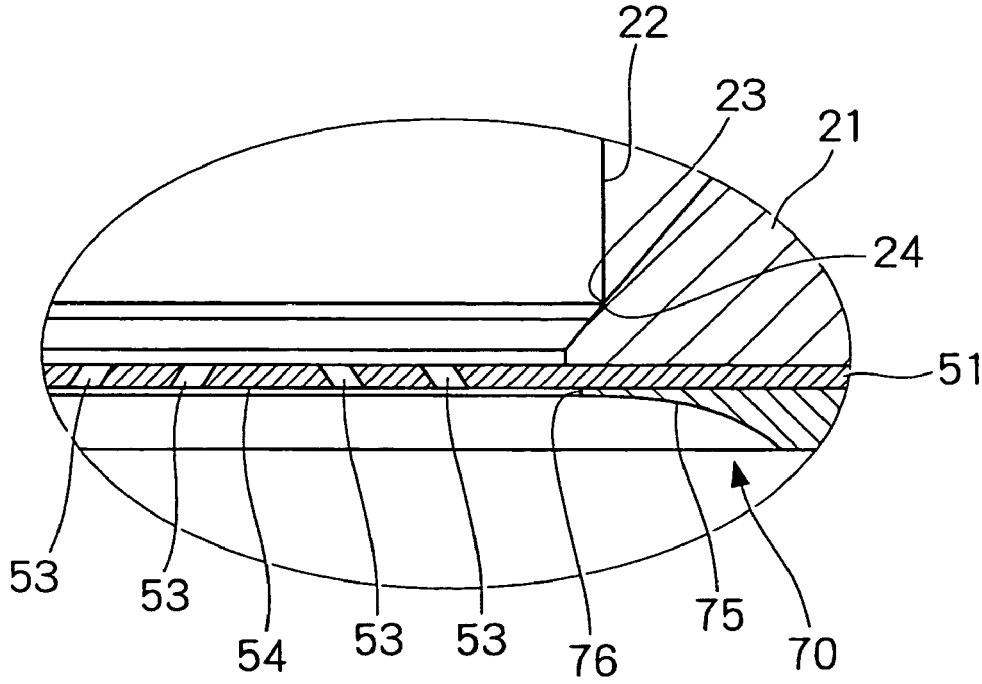
FIG. 6 is an enlarged cross-sectional view of a portion of a nozzle of an injector according to a third embodiment of the present invention.
Figure 7:
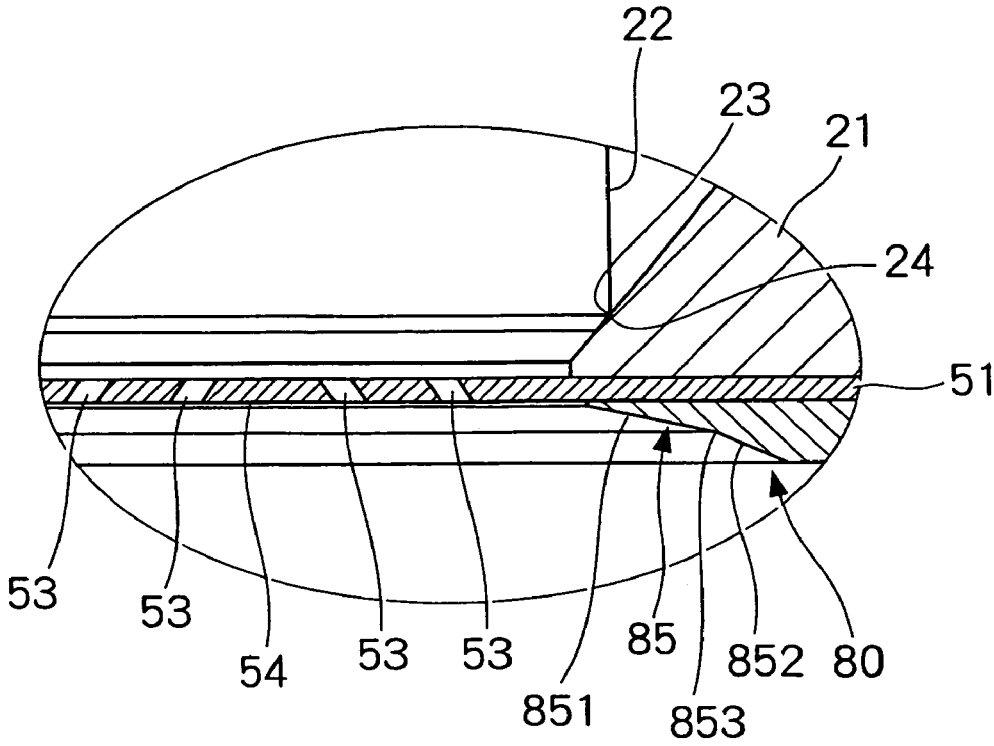
FIG. 7 is an enlarged cross-sectional view of a portion of a nozzle of an injector according to a fourth embodiment of the present invention.

FIGS. 6 and 7 show nozzles of injectors according to third and fourth embodiments of teachings of the present invention, respectively. The third and fourth embodiments are modifications of the foregoing second embodiment, and the same reference numerals as those of the second embodiment refer to substantially identical components, and so descriptions thereof will be omitted.

In the third embodiment, as shown in FIG. 6, the shape of an enlargement section 75 of a holder 70 is different from that of the second embodiment. The enlargement section 75 is formed in the shape of a curved surface recessed toward a valve seat 23 of a nozzle body 21. Namely, a tangent to the enlargement section 75 at an end portion on the side of the nozzle body 21 is approximately orthogonal to a central axis, but a tangent at an end portion on the opposite side to the nozzle body 21 is approximately parallel with the central axis. Since the tangent to the enlargement section 75 at the end portion on the side of the nozzle body 21 is approximately orthogonal to the central axis, an angle between an outlet section 54 and the enlargement section 75 becomes large, that is, close to 180 degrees. The larger the angle between the outlet section 54 and the enlargement section 75, and the smaller the step 76 formed in the inner periphery of the holder 70, the harder it is for fuel to accumulate.

In the third embodiment, an angle formed between the outlet section 54 and the enlargement section 75 in an edge of the outlet section 54 becomes large, because the enlargement section 75 is in the shape of a curved surface recessed toward the nozzle body 21. Thus, the fuel, which has been left in the fuel outlets of the injection holes 53 in injecting the fuel, flows along the enlargement section 75 without accumulating in the connection section between the outlet section 54 and the enlargement section 75. Accordingly, the solidified fuel does not adhere in the vicinity of the fuel outlets of the injection holes 53, so that it is possible to prevent clogging of the injection holes 53. Therefore, it is possible to achieve the desired injection characteristics, and realize atomization of the fuel.

In the fourth embodiment, as shown in FIG. 7, the shape of an enlargement section 85 of a holder 80 is different from that of the second embodiment. The enlargement section 85 has a plurality of tapered surfaces, each of which forms a different angle with a central axis. In the case of the fourth embodiment, the enlargement section 85 has a first tapered surface 851 and a second tapered surface 852, each of which forms a different angle with the central axis. The first tapered surface 851, which is close to an injection hole plate 51, forms a large angle with the central axis, as compared with the second tapered surface 852 which is far from the injection hole plate 51. To prevent fuel from accumulating in a connection section 853 between the first and second tapered surfaces 851 and 852, it is preferable that the first tapered surface 851 and the second tapered surface 852 form an angle larger than 90 degrees.

Since the enlargement section 85 is composed of the plurality of tapered surfaces, each of which has a different inclination angle, as with the fourth embodiment, an outlet section 54 and the enlargement section 85 form a large angle that approaches 180 degrees in an edge of the outlet section 54. Thus, fuel, which has been left on the fuel outlets of injection holes 53 in injecting the fuel, flows along the enlargement section 85 without accumulating in a connection section between the outlet section 54 and the enlargement section 85. Accordingly, the solidified fuel does not adhere in the vicinity of the fuel outlets of the injection holes 53, so that it is possible to prevent clogging of the injection holes 53. Therefore, it is possible to achieve the desired injection characteristics and realize atomization of the fuel.

In the fourth embodiment, the enlargement section 85 has the two tapered surfaces, i.e., the first tapered surface 851 and the second tapered surface 852, but the enlargement section 85 may have three or more tapered surfaces. In a case that the enlargement section 85 has three or more tapered surfaces, if the tapered surface close to the injection hole plate 51 forms a large angle with respect to the central axis, the same effect as that of the fourth embodiment can be provided.

Other Embodiments

Figure 8:
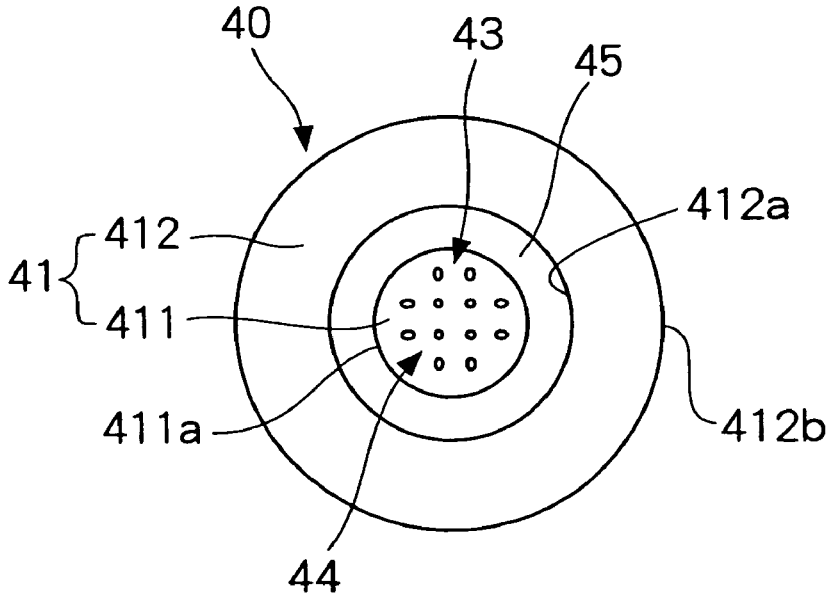
FIG. 8 is a schematic view showing the disposition of injection holes in a nozzle of an injector according to another embodiment of the present invention.

In the embodiments described above, as shown in FIG. 3, the plurality of injection holes 43 are disposed in the bottom section 41 of the injection hole member 40 in the shape of a cross. The injection holes 43, however, may be disposed in a plurality of columns and a plurality of rows crossing with one another as shown in FIG. 8. The arrangement of the injection holes 43 is not limited to examples shown in FIGS. 3 and 8, and such an arrangement may take on a variety of configurations.

In the foregoing embodiments, the present invention is applied to the injector for injecting fuel into the intake port of a gasoline engine, but is not limited thereto. The present invention is applicable to an injector of, for example, a direct-injection gasoline engine or a diesel engine, in addition to this type of injector.

Furthermore, in the foregoing embodiments, the injection holes are formed in the injection hole member or the injection hole plate attached to the nozzle body. The injection holes may be directly formed in the nozzle body, and the outlet section and the enlargement section may be formed in the nozzle body. Furthermore, each of the foregoing embodiments is separately applied to the injector, but the combination of the foregoing embodiments may be applied to the injector. Furthermore, the enlargement section may be formed in the shape of an arc or stepped shape, instead of the foregoing shape.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel injection valve comprising:

a nozzle having a valve seat formed in an inner wall of said nozzle, and an injection hole defined on an outlet side of a fuel flow of said valve seat to inject fuel;

an outlet section, at which a fuel outlet of said injection hole is open, provided to said nozzle on a side opposite to said valve seat and an enlargement section extending in an opposite direction to said valve seat while being gradually and continuously enlarged in thickness from an inner periphery surrounding said outlet section in a radial direction to an outer periphery, wherein an area defined by said outer periphery of the enlargement section is at least twice as large as an area formed by said inner periphery of the enlargement section.

2. The fuel injection valve according to claim 1, wherein said enlargement section has a tapered surface.

3. The fuel injection valve according to claim 1, wherein said enlargement section has a plurality of tapered surfaces, each tapered surface forming a different angle with a central axis of said nozzle, and said tapered surface close to said outlet section forms a larger angle with said central axis of said nozzle as compared with the tapered surface far from said outlet section.

4. The fuel injection valve according to claim 1, wherein said enlargement section has a curved surface recessed toward said valve seat.

5. The fuel injection valve according to claim 1, said nozzle further comprising:

a nozzle body having said valve seat; and an injection hole member provided to said nozzle body on the side opposite to said valve seat, said injection hole being formed in said injection hole member, said injection hole member having said outlet section and said enlargement section on the side opposite to said nozzle body.

6. The fuel injection valve according to claim 5, wherein said injection hole member has a cup shape having a bottom section and a cylindrical section, said bottom section being provided with said injection hole, said outlet section, and said enlargement section, and said cylindrical section having a thickness thinner than said bottom section and extending from a radially outward end portion of said bottom section toward said nozzle body to cover an outer periphery of said nozzle body, and said injection hole member is held by said nozzle body at said cylindrical section.

7. The fuel injection valve according to claim 1, said nozzle further comprising:

a nozzle body having said valve seat;

an injection hole member provided to said nozzle body on the side opposite to said valve seat, said injection hole being formed in said injection hole member, said injection hole member having said outlet section at an end portion on the side opposite to said nozzle body; and a holder provided to said injection hole member on the side opposite to said nozzle body, said injection hole member being sandwiched between said holder and said nozzle body, said holder having said enlargement section.

8. The fuel injection valve according to claim 7, wherein said holder has a cup shape having a bottom section and a cylindrical section, said bottom section being provided with said enlargement section, said cylindrical section having a thickness thinner than said bottom section and extending from a radially outward end portion of said bottom section toward said nozzle body to cover an outer periphery of said nozzle body, and said holder is held by said nozzle body at said cylindrical section.

9. The fuel injection valve according to claim 1, wherein said inner periphery of said enlargement section substantially corresponds to an inner periphery of said outlet side of said valve seat.

10. A fuel injection valve comprising:

a nozzle having a valve seat formed in an inner wall of said nozzle, and an injection hole defined on an outlet side of a fuel flow of said valve seat to inject fuel;

an outlet section, at which a fuel outlet of said injection hole is open, provided to said nozzle on a side opposite to said valve seat; and an enlargement section extending in an opposite direction to said valve seat while being gradually enlarged from said outlet section in a radial direction, wherein said enlargement section has a plurality of tapered surfaces, each tapered surface forming a different angle with a central axis of said nozzle, and said tapered surface close to said outlet section forms a larger angle with said central axis of said nozzle as compared with the tapered surface far from said outlet section.

11. A fuel injection valve comprising:

a nozzle having a valve seat formed in an inner wall of said nozzle, and an injection hole defined on an outlet side of a fuel flow of said valve seat to inject fuel;

an outlet section, at which a fuel outlet of said injection hole is open, provided to said nozzle on a side opposite to said valve seat;

an enlargement section extending in an opposite direction to said valve seat while being gradually enlarged from said outlet section in a radial direction; and said nozzle further comprising:

a nozzle body having said valve seat; and an injection hole member provided to said nozzle body on the side opposite to said valve seat, said injection hole being formed in said injection hole member, said injection hole member having said outlet section and said enlargement section on the side opposite to said nozzle body, wherein said injection hole member has a cup shape having a bottom section and a cylindrical section, said bottom section being provided with said injection hole, said outlet section, and said enlargement section, and said cylindrical section having a thickness thinner than said bottom section and extending from a radially outward end portion of said bottom section toward said nozzle body to cover an outer periphery of said nozzle body, and said injection hole member is held by said nozzle body at said cylindrical section.

* * * * *